US005214345A

United States Patent [19]

Saito et al.

[11] Patent Number: 5,214,345

[45] Date of Patent: May 25, 1993

[54] ULTRAVIOLET RAY-SHIELDING AGENT AND TUBE

[75] Inventors: Kanehiro Saito, Chiba; Mitsumasa Saito, Narashino, both of Japan

[73] Assignee: Sumitomo Cement Company, Ltd., Tokyo, Japan

[21] Appl. No.: 733,051

[22] Filed: Jul. 15, 1991

Related U.S. Application Data

[63] Continuation of Ser. No. 442,819, Nov. 29, 1989, abandoned.

[30] Foreign Application Priority Data

Mar. 28, 1989 [JP] Japan ..... 1-73874

[51] Int. Cl.[5] ..... H01J 61/40; H01J 5/16

[52] U.S. Cl. ..... 313/112; 313/635; 359/359; 359/361; 359/580

[58] Field of Search ..... 313/110, 112, 635, 503, 313/495; 350/1.1, 1.6, 164; 252/588

[56] References Cited

U.S. PATENT DOCUMENTS

| | | | |
|---|---|---|---|
| 2,774,903 | 12/1956 | Burns . | |
| 3,988,628 | 10/1976 | Clausen | 313/112 |
| 4,680,504 | 7/1987 | Helvy et al. | 313/112 X |
| 4,710,677 | 12/1987 | Halbeistadt et al. | 313/116 |
| 4,717,852 | 1/1988 | Dobrusskin et al. | 513/112 X |
| 4,792,716 | 12/1988 | Walsh . | |
| 4,831,269 | 5/1989 | Kagami et al. | 313/495 |
| 4,855,189 | 8/1989 | Simopalos et al. | 313/503 X |

FOREIGN PATENT DOCUMENTS

| | | | |
|---|---|---|---|
| 1915510 | 9/1970 | Fed. Rep. of Germany . | |
| 0158630 | 12/1975 | Japan | 252/588 |
| 1245201 | 9/1989 | Japan | 252/588 |
| 275957 | 9/1951 | Switzerland . | |
| 937448 | 9/1963 | United Kingdom . | |
| 2184356 | 6/1987 | United Kingdom . | |

*Primary Examiner*—Sandra L. O'Shea
*Assistant Examiner*—Brian Zimmerman
*Attorney, Agent, or Firm*—Nikaido, Marmelstein, Murray & Oram

[57] ABSTRACT

An ultraviolet ray-shielding agent for selectively shielding ultraviolet rays while allowing a transmission of visible rays therethrough, comprising a visible ray-transmitting binder and extremely fine zinc oxide particles having an average size of 0.1 μm or less in a mixing ratio of the zinc oxide particles to the binder of 1/10 to 10/1, and an ultraviolet ray-shielding tube for visible ray-irradiation luminescent lamps comprising a transparent substrate tube for sealing a light emission source therein, and a coating formed on a surface of the substrate tube and comprising the above-mentioned ultraviolet ray-shielding agent.

2 Claims, 4 Drawing Sheets

ULTRAVIOLET RAY-SHIELDING AGENT AND TUBE

This application is a continuation of application Ser. No. 442,819 filed Nov. 29, 1989 now abandoned.

BACKGROUND OF THE INVENTION

1. Field of the Invention

The present invention relates to an ultraviolet ray-shielding agent and tube. More particularly, the present invention relates to an ultraviolet ray-shielding agent and tube for a discharge lamp.

2. Description of the Related Arts

It is known that various types of luminescent lamps, for example, mercury lamps, metal halide vapor lamps, sodium lamps, xenon lamps and halogen lamps, have an excellent luminance and brightness, a high illumination efficiency, and a long durability, and thus are useful for illuminating buildings such as shops, and as fish-luring lamps.

Luminescent lamps irradiate strong ultraviolet rays in addition to visible rays, and due to recent increases in the luminance or brightness of the luminescent lamps, for example, halogen lamps, the ultraviolet ray-radiation therefrom can no longer be ignored. Namely, when these lamps are used to illuminate, for example, department stores, the ultraviolet rays cause a discoloration and deterioration of the goods, and when used as fish-luring lights, the ultraviolet rays burn the skin of the users and may cause skin cancer or a deterioration of the eyesight of the users. Therefore, it is necessary that some form of shielding from the ultraviolet rays emitted by luminescent lamp be provided.

Several attempts have been made to shield the ultraviolet rays, as shown in the following description:

(1) In a metal vapor luminescent lamp, a coating layer of a titanium dioxide is formed on an outside or inside surface of a tube or bulb in which a luminescent source is contained.

(2) In a xenon lamp, a tube or bulb for containing a luminescent source is made from a transparent quartz containing 10 to 300 ppm of at least one member selected from titanium dioxide and cerium oxide.

Nevertheless, in the above-mentioned ultraviolet ray-shielding tubes, titanium dioxide or cerium oxide is utilized as the ultraviolet ray-shielding material, but these compounds are disadvantageous in that they have the following properties:

(1) A high refractive index and a poor transparency, and thus the luminance of the luminescent lamp is lowered.

(2) When titanium dioxide is used in the form of fine particles, the particles absorb visible rays, and thus the luminance or brightness and color-rendering property of the lamp are lowered, due to a relatively large size of these particles.

(3) When an organic titanium compound is employed, it is difficult to form a coating layer having a large thickness, and thus the resultant coating layer exhibits an unsatisfactory ultraviolet ray-shielding property.

(4) The transparent quartz containing titanium dioxide or cerium oxide is expensive. Also there is an upper limit to the amount of titanium dioxide or cerium oxide that can be added to the quartz, and thus the ultraviolet ray-shielding property of the resultant quartz tube or bulb is still unsatisfactory.

Generally, ultraviolet ray-shielding coating materials must satisfy all of the following requirements:

(1) The coating material must be able to shield ultraviolet rays at a wave length of around 400 nm or less.

(2) The coating material must be stable for practical use over a long period.

(3) The coating material must be harmless to the human body.

The conventional ultraviolet ray-shielding agents however, cannot satisfy all of the above-mentioned requirements.

SUMMARY OF THE INVENTION

An object of the present invention is to provide an ultraviolet ray-shielding agent and a tube using such for luminescent lamps, which have a high transparency to and a low scattering of visible rays, and provide an effective shield against ultraviolet rays.

The above-mentioned object can be attained by the ultraviolet ray-shielding agent and tube of the present invention for luminescent lamps.

The ultraviolet ray-shielding agent of the present invention comprises; a binder capable of transmitting visible rays therethrough, and extremely fine zinc oxide particles having an average size of 0.1 μm or less and dispersed in the binder in a weight mixing ratio of the zinc oxide particles to the binder of 1:10 to 10:1.

Also, the ultraviolet ray-shielding tube of the present invention for visible ray-irradiation luminescent lamps comprises a transparent substrate tube for sealing a light emission source therein, and at least one ultraviolet ray-shielding coating formed on at least one surface of the substrate tube, comprising a binder capable of transmitting visible rays therethrough and extremely fine zinc oxide particles having an average size of 0.1 μm or less and dispersed in the binder in a mixing ratio of the zinc oxide particles to the binder of 1:10 to 10:1; this coating having a thickness of 0.5 to 50 μm.

The ultraviolet ray-shielding agent and tube of the present invention provide an effective shield against ultraviolet rays without reducing the luminance or brightness and the color-rendering property of the luminescent lamps.

DESCRIPTION OF THE PREFERRED EMBODIMENTS

Figure 1A:
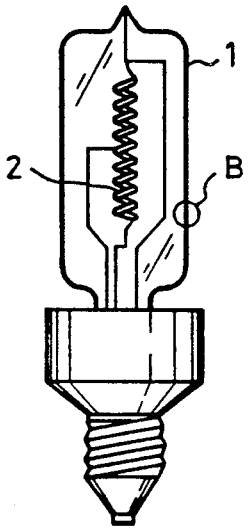
FIG. 1A is a cross-sectional view of a halogen luminescent lamp to which ultraviolet ray-shielding tube of the present invention is applied.

The ultraviolet ray-shielding agent of the present invention usable for luminescent lamps, comprises a binder capable of transmitting visible rays therethrough and extremely fine zinc oxide (ZnO) particles having an average size of 0.1 μm or less, and dispersed in the binder. The mixing ratio of the zinc oxide particles to the binder is from 1:10 to 10:1.

The upper end wave length in the ultraviolet ray-absorption of zinc oxide is about 380 nm; which is very close to 400 nm, an upper end of the ultraviolet ray band.

The conventional zinc oxide particle having a size of more than 0.1 μm exhibit high visible ray-scattering and shielding properties and thus appear white, and therefore, the conventional zinc oxide particles are used as a white pigment. But when used as a coating material for a luminescent lamp, the conventional zinc oxide particles reduce the luminance and color-rendering property of the luminescent lamp, and thus the conventional zinc oxide particles are useless as a visible ray-transmitting coating material.

The extremely fine zinc oxide particles of the present invention having a size of 0.1 μm or less have a very sharp end in the ultraviolet ray absorption located at a wave length close to 400 nm and can transmit and scatter the visible rays, and therefore, are very suitable as a coating material capable of transmitting and scattering the visible rays and selectively shielding the ultraviolet rays.

In the ultraviolet ray-shielding agent of the present invention, the extremely fine zinc oxide particles having an average size of 0.1 μm or less are evenly dispersed, preferably in the binder, in a mixing ratio of the zinc oxide particle to the binder, of 1:10 to 10:1, preferably 2:1 to 1:2.

When the mixing ratio is lower than 1/10, the resultant ultraviolet ray-shielding agent exhibits an unsatisfactory ultraviolet ray-shielding effect. Also, a mixing ratio of higher than 10/1 causes the resultant ultraviolet ray-shielding agent layer to exhibit an unsatisfactory mechanical strength.

The binder usable for the present invention must be capable of forming a solid film having a high transparency for visible rays, a satisfactory heat resistance and durability, provide a satisfactory dispersion of the extremely fine zinc dioxide particles therein, and firmly adhere to a substrate tube or bulb for containing an emission source.

Also, the binder should have a thermal expansion coefficient similar to that of the substrate tube.

The binder usable for the present invention preferably comprises at least one member selected from the group-consisting of colloidal silica, polysiloxanes, polyborosiloxanes, polycarbosilanes, and polyphosphazenes.

The colloidal silica is preferably selected from aqueous silica sol and a hydrolysis product of a silicon alkoxide. The polysiloxane can be selected from conventional polysiloxane resins.

The binder may contain specific metal ions or boron to adjust the thermal expansion coefficient of the resultant ultraviolet ray-shielding coating layer to the same level as that of the substrate tube of the luminescent lamp.

The extremely fine zinc oxide particles can be evenly mixed with and dispersed in the binder, together with a solvent for the binder, by using one or more conventional mixing and dispersing devices, for example, a ball mill, sand mill, atomizer, roll mill, homogenizer, and paint shaker.

The ultraviolet ray-shielding tube of the present invention for visible ray-irradiation luminescent lamps comprises a transparent substrate tube for sealing a light emission source therein, and at least one ultraviolet ray-shielding coating layer formed on at least one surface of the substrate tube. The coating layer comprises the ultraviolet ray-shielding agent as mentioned above, and has a thickness of 0.5 to 50 μm, preferably, 3 to 30 μm.

When the thickness is less than 0.5 μm, the resultant coating layer exhibits an unsatisfactory ultraviolet ray-shielding effect. Also, when the thickness is more than 50 μm, the resultant coating layer reduces the luminance and color-rendering property of the tube.

The transparent substrate tube is usually formed of a glass, for example, a quartz glass.

The substrate tube to be coated with the ultraviolet ray-shielding agent may be an outer bulb of a luminescent lamp or an inner tube for sealing a light emission source of a luminescent lamp.

There is no specific restriction on the type of luminescent lamps to which the ultraviolet ray-shielding tube of the present invention can be applied, but usually the luminescent lamp is selected from the group consisting of mercury vapor lamps, metal halide vapor lamps, sodium lamps, xenon lamps, and halogen lamps. For example, the ultraviolet ray shielding coating layer is formed, in a xenon lamp or halogen lamp, on either one or both of the outside and inside surfaces of the outer bulb, and in a mercury vapor lamp, metal halide vapor lamp or sodium lamp, on either one or both of the outside and inside surfaces of an outer bulb or on the outside surface of an inner bulb.

Figure 1B:
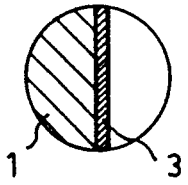
FIG. 1B is a magnified cross-sectional view of a portion B of the ultraviolet ray-shielding tube shown in FIG. 1A.

Referring to FIGS. 1A and 1B, a halogen lamp has a outer bulb 1 made from a quartz glass and a light emission source 2 (tungsten filaments), and an ultraviolet ray-shielding coating 3 is formed on an outside surface of the outer bulb 1; i.e., the coating layer 3 is exposed to the ambient air atmosphere.

Figure 4A:
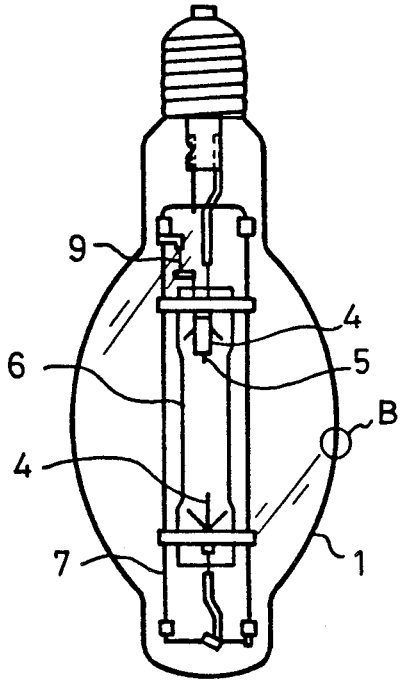
FIG. 4A is a cross-sectional view of a mercury luminescent lamp provided with an ultraviolet ray-shielding outer tube according to the present invention.
Figure 4B:
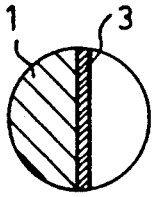
FIG. 4B is a magnified cross-sectional view of a portion B of the ultraviolet ray-shielding tube shown in FIG. 4B.

Referring to FIGS. 4A and 4B, a mercury vapor lamp has an outer bulb 1, main electrodes 4, supplementary electrodes 5, a light-emission inner tube 6, conductive supporting rods 7, and an initiating resistance element 9, and an ultraviolet ray-shielding coating 3 is formed on the outside surface of the outer tube 1; i.e., the coating layer 3 is exposed to the ambient air atmosphere.

Figure 7A:
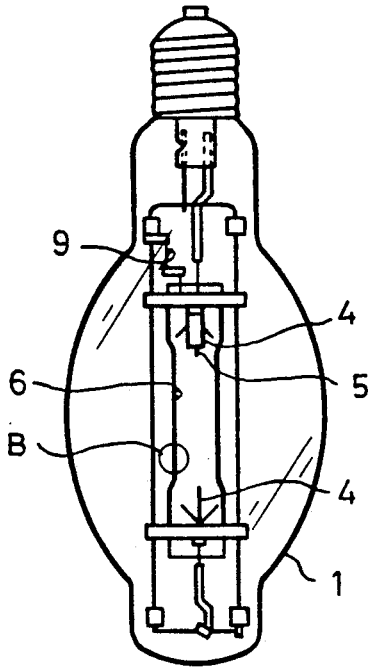
FIG. 7A is a cross-sectional view of another mercury luminescent lamp provided with an ultraviolet ray-shielding inner tube according to the present invention.
Figure 7B:
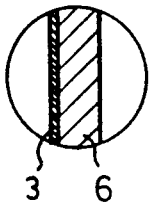
FIG. 7B is a magnified cross-sectional view of a portion B of the ultraviolet ray-shielding inner tube shown in FIG. 7A; and, FIG. 8 is a graph showing a relationship between a wave length and a relative intensity of light emission of rays irradiated through an ultraviolet ray-shielding tube of the present invention applied to a mercury luminescent lamp, as shown in FIG. 7A and 7B.

Referring to FIGS. 7A and 7B, an ultraviolet ray-shielding coating 3 is formed on the outside surface of the light-emission inner tube 6. The coating 3 is exposed to the gas atmosphere contained in the outer bulb 1.

The ultraviolet ray-shielding coating can be formed by applying a coating liquid containing the ultraviolet ray-shielding agent of the present invention on a surface of an outer or inner bulb of the luminescent lamp, by a dipping method, spraying method, flow coating method, or brushing method, and solidifying the coated liquid by drying.

EXAMPLES

The present invention will be further explained in the following specific examples, which are representative and do not restrict the scope of the present invention.

EXAMPLE 1

A mixture of 100 parts by weight of tetraethoxy silane, 300 parts by weight of isopropyl alcohol, and 35 parts by weight of a 0.1N hydrochloric acid aqueous solution was stirred at a temperature of 60° C. for 2 hours to prepare an aqueous silica colloid dispersion. The resultant aqueous silica colloid dispersion was mixed with 30 parts by weight of zinc oxide particles having a size of from 0.005 μm to 0.02 μm and an average size of 0.01 μm, and the mixture was dispersed in a sand mill for 2 hours to provide a coating liquid. This coating liquid contained extremely fine particles of zinc oxide and silica, 99% by weight of which have a size of 0.1 μm or less.

A quartz outer bulb for a 100 W halogen luminescent lamp was immersed in the coating liquid and taken up at a constant speed to form a liquid coating having an even thickness on the outside surface of the bulb and the liquid coating was dried at a temperature of 150° C. for 15 minutes, to provide a transparent coating having a thickness of 1.5 μm.

Figure 2:
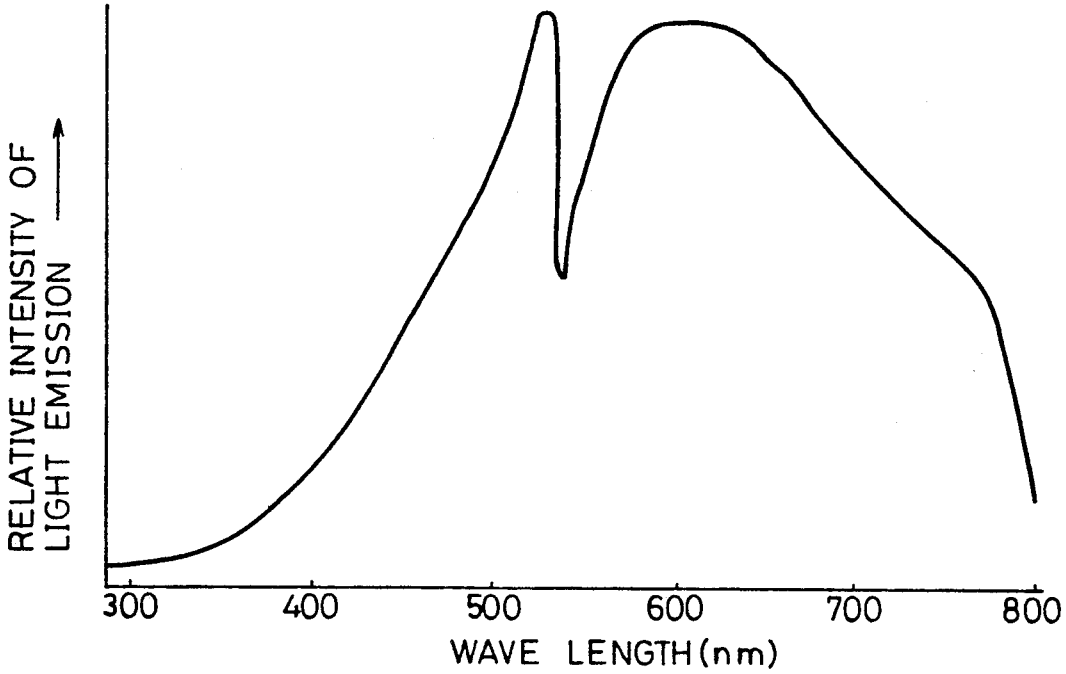
Fig. 2 (PRIOR ART)
FIG. 2 is a graph showing a relationship between a wave length and a relative intensity of light emission of rays irradiated from a halogen luminescent lamp through a conventional outer bulb.

When a non-coated outer bulb was used, the resultant conventional halogen luminescent lamp had the relationship between a wave length and a relative intensity of emission of irradiated rays through the non-coated outer bulb, as shown in FIG. 2. In FIG. 2, the rays irradiated through the non-coated outer bulb contain a specific intensity of ultraviolet rays having a wave length of 400 nm or less. The conventional lamp exhibited an intensity of illumination and a quantity of ultraviolet ray irradiation as shown in Table 1.

Figure 3:
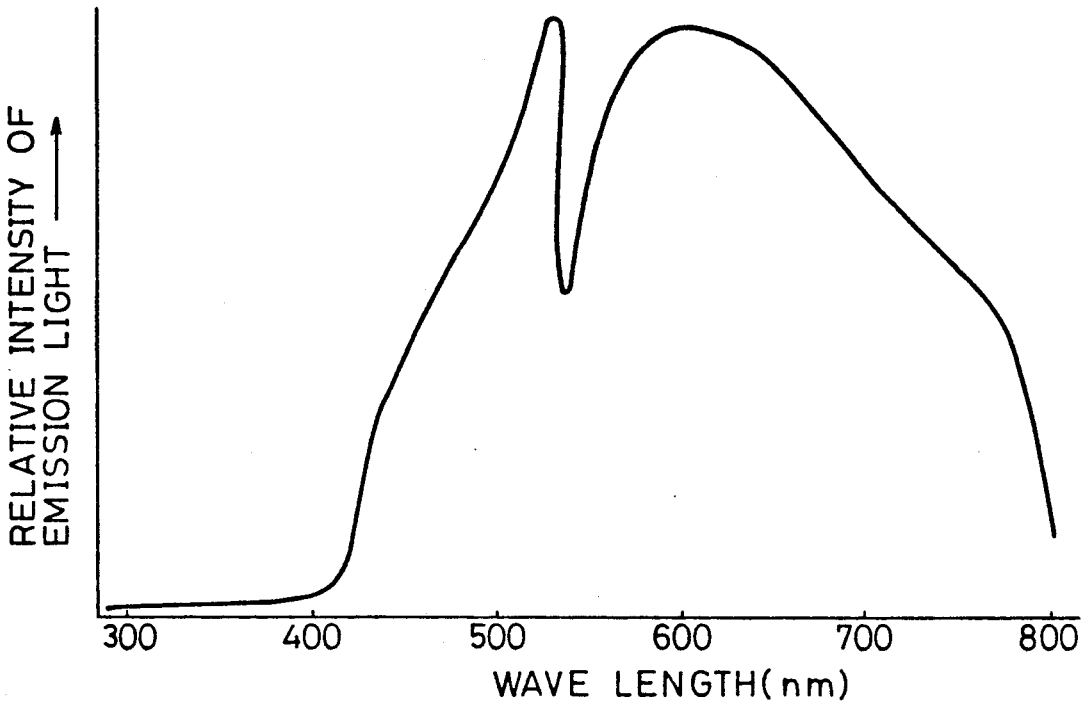
FIG. 3 is a graph showing a relationship between a wave length and a relative intensity of light emission of the rays irradiated from a halogen luminescent lamp through an ultraviolet ray-shielding tube of the present invention.

FIG. 3 shows a relationship between a wave length and a relative intensity of emission of rays irradiated from the halogen luminescent lamp through the outer bulb coated with the ultraviolet ray-shielding agent. In a comparison of FIG. 3 with FIG. 2, it is clear that the coating formed on the outer bulb surface shielded only the ultraviolet rays, without shielding the visible rays.

The halogen luminescent lamp having the coated outer bulb exhibited the intensities of illumination and quantities of ultraviolet ray irradiation at the initial stage of the lighting operation and at 1000 hours after the start of the lighting operation, as indicated in Table 1.

EXAMPLE 2

The same coating liquid as mentioned in Example 1 was applied to an outside surface of a quartz outer bulb of a 1000 W mercury vapor luminescent lamp by a flow-coating method and the resultant liquid coating was dried at a temperature of 150° C. for 15 minutes.

The above-mentioned procedures were repeated twice to provide a transparent coating having a thickness of 2.5 μm.

Figure 5:
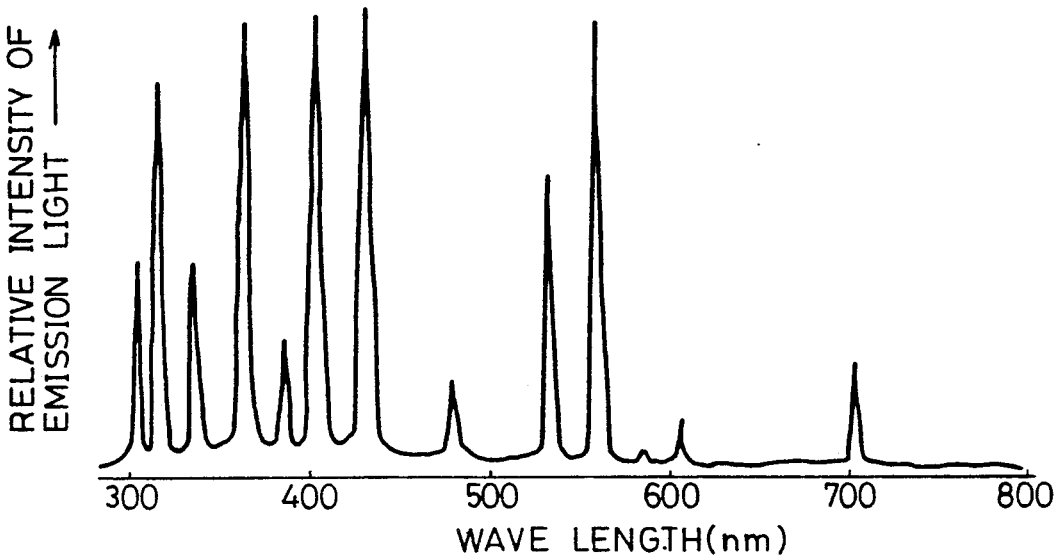
Fig. 5 (PRIOR ART)
FIG. 5 is a graph showing a relationship between a wave length and a relative intensity of light emission of the rays irradiated from a conventional mercury luminescent lamp.

Before the application of the coating liquid, the non-coated outer bulb exhibited a spectral transmittance performance as indicated in FIG. 5. FIG. 5 shows that the non-coated outer bulb allowed the transmission of ultraviolet rays having a wave length of about 400 nm or less therethrough.

The conventional mercury vapor luminescent lamp having the non-coated outer bulb exhibited the intensity of illumination and quantity of ultraviolet ray irradiation as shown in Table 1.

Figure 6:
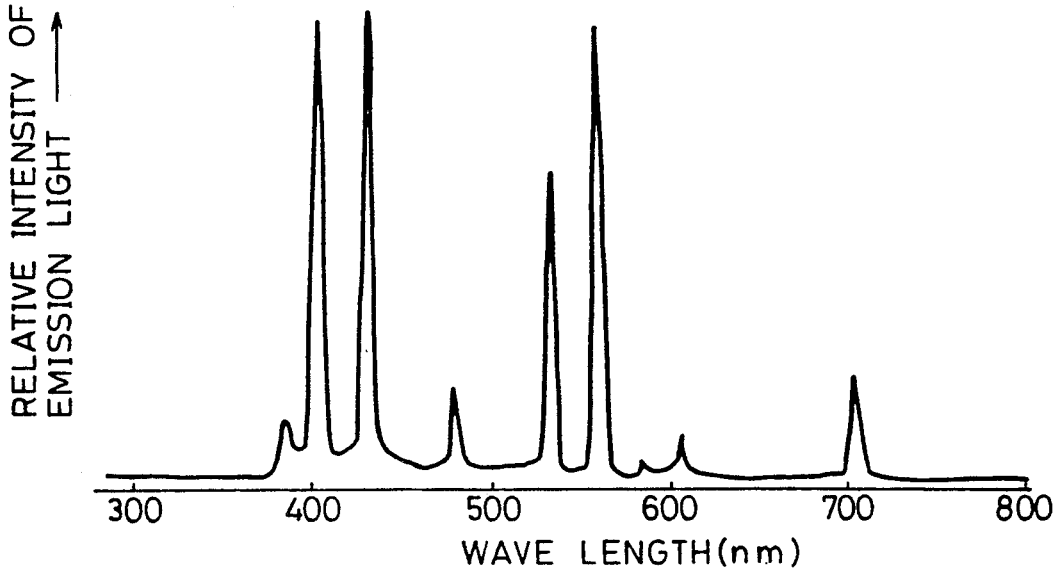
FIG. 6 is a graph showing a relationship between a wave length and a relative intensity of light emission of the rays irradiated through an ultraviolet ray-shielding tube of the present invention when applied to a mercury luminescent lamp.

After coating with the coating liquid containing the ultraviolet ray-shielding agent of the present invention, the resultant coated outer bulb did not allow a transmission of the ultraviolet rays therethrough, as indicated in FIG. 6. Also, from a comparison of FIG. 6 with FIG. 5, it is clear that the coated outer bulb did not shield the visible rays.

The mercury vapor luminescent lamp having the coated outer bulb exhibited the intensities of illumination and quantities of ultraviolet ray irradiation at the initial stage of the lighting operation, and at 1000 hours after the start of the lighting operation, as indicated in Table 1.

EXAMPLE 3

A light-emission inner bulb made from a quartz glass was immersed in the same coating liquid as described in Example 1 and taken up at a constant speed and the resultant coating formed on the outer surface of the inner bulb was dried at a temperature of 500° C. for minutes. The above-mentioned procedures were repeated twice, and the resultant transparent coating had a thickness of 2.0 μm.

The coated inner bulb was inserted into an outer bulb made from a brone-silicic acid glass to provide a 1000 W mercury vapor luminescent lamp as shown in FIGS. 7A and 7B.

Figure 8:
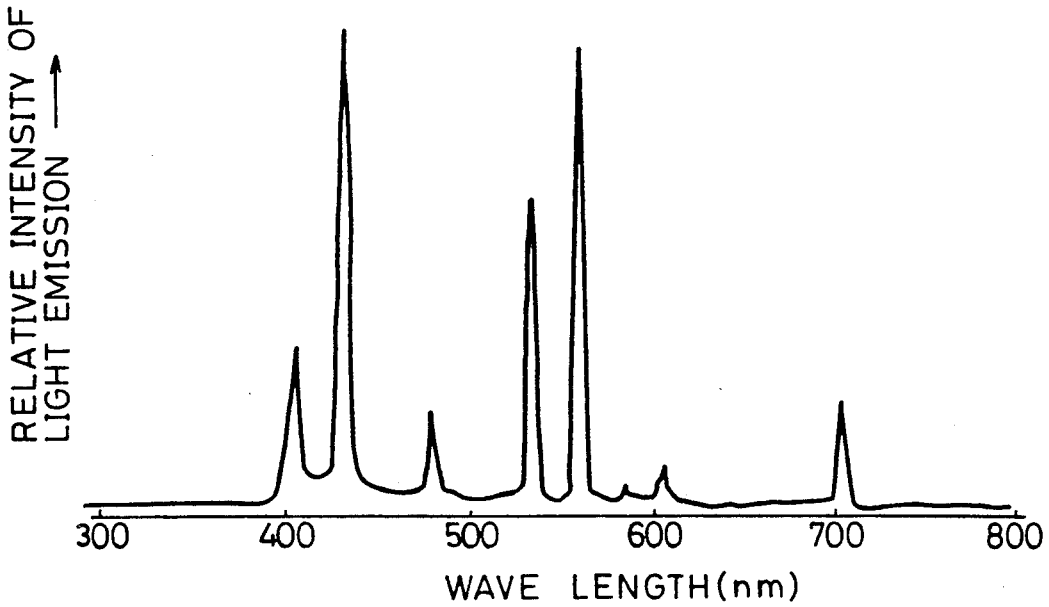

The resultant mercury vapor luminescent lamp exhibited a spectral transmittance performance as indicated in FIG. 8. FIG. 8 clearly shows that the ultraviolet rays having a wave length of about 400 nm or less are shielded by the coated inner bulb.

A comparative conventional mercury vapor luminescent lamp having a non-coated inner bulb exhibited intensity of illumination and quantity of ultraviolet ray irradiation as shown in Table 1.

Also, the mercury vapor luminescent lamp having the coated inner bulb exhibited the intensities of illumination and quantities of ultraviolet ray irradiation at the initial stage of the lighting operation, and at 1000 hours after the start of the lighting operation, as indicated in Table 1.

COMPARATIVE EXAMPLE 1

The same procedures as those described in Example 1 were carried out except that the zinc oxide particles in the coating layer of Example 1 were replaced by titanium oxide particles in the coating liquid of a size of from 0.05 to 0.1 μm and an average size of 0.08 μm. The resultant coating liquid was applied to the outside surface of a quartz outer bulb of the same 1000 W mercury vapor luminescent lamp as in Example 2.

The properties of the comparative lamp having a non-coated bulb and another comparative lamp having such a coated bulb are shown in Table 1.

TABLE 1

| Item | | | Example No. | | | |
|---|---|---|---|---|---|---|
| | | | Example | | | Comparative |
| Type of bulb | Property | | 1 | 2 | 3 | Example 1 |
| Non-coated | Intensity of illumination (1×) | | 138,800 | 7,880 | 7,880 | 7,880 |
| | Quantity of ultraviolet ray irradiation ($mW/m^2$) | | 1.00 | 1.02 | 1.02 | 1.02 |
| Coated | Intensity of illumination (1×) | Initial stage | 14,490 | 8,060 | 8,260 | 6,700 |
| | | 1000 hr after | 14,000 | 7,900 | 8,100 | 6,430 |
| | Quantity of ultraviolet ray irradiation ($mW/m^2$) | Initial stage | 0 | 0 | 0 | 0 |
| | | 1000 hr after | 0 | 0 | 0 | 0 |

Note:
The intensity of illumination and quantity of ultraviolet ray irradiation were measured at a point 10 cm from the center of the luminescent lamp in Example 1, and 60 cm from the center of the luminescent lamp in Examples 2 and 3 and Comparative Example 1.

Table 1 clearly shows that, in each of Examples 1 to 3, the resultant ultraviolet ray shielding layer of the present invention did not reduce the intensity of illumination of the luminescent lamp but caused an increase thereof, and had a high durability over a long period of time.

In Comparative example 1, however, the use of titanium dioxide particles having an average size of 0.0800 μm caused the resultant luminescent lamp to exhibit a reduced intensity of illumination.

We claim:

1. An ultraviolet ray-shielding tube for visible ray irradiation luminescent lamps, comprising:

a substrate tube adapted to seal a light emission source, comprising a member selected from the group consisting of mercury vapor lamp, metal halide vapor lamp, sodium lamp, xenon lamp, and halogen lamp, therein; and at least one ultraviolet ray-shielding coating having a thickness of 0.5 to 50 μm, formed on at least one surface of the substrate tube, comprising:

a binder capable of transmitting visible rays therethrough consisting essentially of at least one of colloidal silica, polysiloxanes, polyborosiloxanes, polycarbosilanes and polyphosphazenes; and extremely fine zinc oxide particles having an average size in the range of 0.005 to 0.02 μm, wherein the average particle size of 99% by weight of said particles is 0.1 μm or less, substantially evenly dispersed in said binder in a weight ratio of the zinc oxide particles to the binder of 1:10 and 10:1.

2. In an irradiation luminescent lamp assembly, adapted to shine visible radiation on an object, comprising:

a source of illumination radiation, selected from the group consisting of mercury vapor lamp, metal halide vapor lamp, sodium lamp, xenon lamp, and halogen, lamp, which emits radiation at least in the visible and in the ultraviolet regions;

a shielding tube at least between said source of illumination and said object; and a coating on said shielding tube, disposed at least between said source of illumination and said object, which decreases the amount of ultraviolet radiation transferred from said source of illumination to said object; the improvement, whereby causing said assembly to emit less ultraviolet radiation and a higher intensity of visible light, which comprises said coating on said shielding tube comprising:

a binder capable of transmitting visible rays therethrough consisting essentially of at least one of colloidal silica, polysiloxanes, polyborosiloxanes, polycarbosilanes and polyphosphazenes; and extremely fine zinc oxide particles having an average size in the range of 0.005 to 0.02 μm, wherein the average particle size of 99% by weight of said particles is 0.1 μm or less, substantially evenly dispersed in said binder in a weight ratio of the zinc oxide particles to the binder of 1:10 and 10:1.

* * * * *